United States Patent [19]

Wohrstein

[11] 4,067,309

[45] Jan. 10, 1978

[54] AIR GUN WITH TRIGGER MECHANISM THEREFOR

[75] Inventor: Edwin Johannes Wohrstein, Oberndorf-Altoberndorf, Germany

[73] Assignee: Feinwerkbau, Westinger & Altenburger KG, Oberndorf, Germany

[21] Appl. No.: 679,144

[22] Filed: Apr. 22, 1976

[30] Foreign Application Priority Data

Apr. 24, 1975 Germany ..... 2518146

[51] Int. Cl.[2] ..... F41B 11/00

[52] U.S. Cl. ..... 124/67; 124/31; 124/37; 124/40

[58] Field of Search ..... 124/31, 37, 38, 40, 124/65, 66, 67, 68, 69, 70, 76, 27; 42/43, 69 R

[56] References Cited

U.S. PATENT DOCUMENTS

| | | | |
|---|---|---|---|
| 226,555 | 4/1880 | Schalck | 42/69 R UX |
| 1,897,226 | 2/1933 | Anson | 124/67 |
| 2,685,284 | 8/1954 | Neal | 124/67 |
| 3,233,601 | 2/1966 | Walther | 124/40 X |
| 3,530,609 | 9/1970 | Staggs | 42/43 |
| 3,899,845 | 8/1975 | Wild et al. | 124/31 X |

FOREIGN PATENT DOCUMENTS

| | | | |
|---|---|---|---|
| 1,183,407 | 12/1964 | Germany | 124/67 |
| 1,037,922 | 8/1958 | Germany | 124/67 |

*Primary Examiner*—Richard T. Stouffer
*Attorney, Agent, or Firm*—John Holtrichter, Jr.

[57] ABSTRACT

A trigger mechanism for an air gun with a cocking mechanism has a trigger and a trigger lever, actuated by the trigger, which retains a tensioned member of the air gun. The trigger lever is coupled with the cocking mechanism by intermediate members in such a manner that when the cocking mechanism is returned to its position of rest, it causes the overlap of the trigger lever over the member retained thereby to be reduced during the last portion of its path of travel.

10 Claims, 7 Drawing Figures

AIR GUN WITH TRIGGER MECHANISM THEREFOR

The present invention relates to a trigger mechanism for an air gun with a cocking mechanism, having a trigger and a trigger lever actuated by the trigger and retaining a tensioned member of the air gun.

Match air guns generally operate with a piston which is guided in an air cylinder and subjected to the force of a strong compression spring; this piston is placed in a cocked position prior to firing by means of a cocking mechanism and released by the trigger mechanism when the air gun is fired, or by means of highly precompressed air which is stored in an air cylinder by means of the cocking mechanism and released by means of a valve actuated by the trigger mechanism when the weapon is fired. In both cases, large forces are required and considerable amounts of energy are stored, so that care must be taken to ensure that these energies are not released prematurely. It is therefore known practice to employ safety mechanisms which prevent the cocking mechanism from snapping back until the cocking sequence has been completed and which prevent the trigger from being pulled, and thus the stored energy from being released, until the loading sequence has been completed. These safety measures include blocking the trigger until the cocking sequence has been completed in order to prevent energy from being released prematurely as a result of unintentionally contacting the trigger, which could result in injuries to the shooter. However it is only possible to block the trigger if there is a significant overlap between the trigger lever and the member retained thereby, so that the member providing the blocking effect must not be subject to excessively close tolerances and the blocking effect is provided with a sufficient degree of security. A sufficient overlap of the trigger lever over the member retained thereby results in considerable trigger travel. In the case of two-stage triggers of the type normally employed in air guns, the trigger travel is so great that it is readily possible to provide a sufficient overlap.

However air guns are not only employed for match shooting, in which a two-stage trigger is desired, but also for hunting-type tournament competition, where single-stage triggers are desired, which should have only very little slack before the shot is fired. Moreover, single-stage triggers of this type should have a light trigger pull. In hunting weapons, a trigger characteristic of this type is frequently achieved by means of a set trigger feature. In principle, it is also possible to equip air guns with a set trigger feature. However additional set trigger features are complicated and expensive. And it is also necessary to ensure that it is not possible to set the trigger before the weapon is cocked in order to retain the effectiveness of the aforementioned safety mechanisms. A further disadvantage is the fact that for hunting-type tournament competition shooting, not only would the weapon have to be recocked after every shot, but it would also be necessary to reset the trigger again each time. Since this is not necessary for match competition with air guns, this additional step can easily be forgotten, which could then result in misses or at least poorer results, as the shooter expected the single-stage trigger instead of the two-stage trigger. In tournament competition, an error of this type can easily result in a lost victory or even a poor showing.

It is thus the object of the present invention to create a trigger mechanism for an air gun having the characteristics of a single-stage trigger with very little slack, yet complying with the safety requirements for an air gun, and which further does not have to be set.

According to the present invention, this object is solved in that the trigger lever is coupled with the cocking mechanism by means of intermediate members in such a manner that when the cocking mechanism is returned to its position of rest, it reduces the overlap of the trigger lever over the member retained thereby during the last portion of its travel.

The safety mechanisms acting on the cocking mechanism are not affected by the trigger mechanism according to the present invention. Moreover, after completion of the cocking sequence, the trigger lever can overlap the tensioned member of the air gun sufficiently to prevent a shot from being fired unintentionally. In particular, it is also possible to block the trigger mechanism. Only when the cocking mechanism has returned almost to its position of rest and a condition has been reached in which there is no further movement of components of the air gun which could injure the shooter when a shot is fired is the overlap of the trigger lever over the member retained thereby reduced sufficiently enough to achieve the desired trigger characteristic. In this connection, the trigger mechanism can be designed and adjusted in such a manner as to achieve the characteristic of a set trigger, in which it is only necessary to pull the trigger a fraction of a millimeter in order to fire the shot. This creates a trigger which is suitable for hunting-type tournament competition, which entails no safety problems whatsoever and does not require any additional steps to make it operational.

A further advantage of the present invention is the fact that conventional trigger mechanisms can be modified to a trigger mechanism according to the present invention through the installation of only a few intermediate members, and that these intermediate members can be made non-operational, if desired, in order to employ one and the same trigger mechanism alternately as a very crisp single-stage trigger or as a trigger with a great deal of slack, in particular as a two-stage trigger. In particular, levers or longitudinal and lateral slides, as individual members or in the form of a linkage, can be employed as the intermediate members and, if necessary, can be in engagement one with the other and/or with the cocking mechanism and/or with the trigger lever directly in their direction of travel or by means of camming surfaces or cams in such a manner as to achieve the desired reduction effect of the motion with respect to magnitude and direction. Intermediate members of this nature do not result in any significant costs and do not require much space. Thus, the trigger mechanism according to the present invention can be realized at very low cost and with a negligible amount of additional space.

In a preferred embodiment of the present invention, the intermediate members displace the trigger in the direction of the trigger. Since the intermediate members act on the trigger itself, i.e. in the same manner as the shooter's finger, it is not necessary to alter the actual trigger mechanism itself in an embodiment of this type. In this connection, in a two-stage trigger the intermediate members can displace the trigger up to the letoff point.

As especially simple method of displacing the trigger is to provide a stop for the position of rest of the trigger, the stop being able to be displaced by means of the cocking mechanism. While the stop assumes a position in which the members of the trigger mechanism are released for a large overlap over the member to be retained with the cocking mechanism actuated, the cocking mechanism places the stop in a position which corresponds to considerable trigger travel when the cocking mechanism is placed in its position of rest.

In an especially advantageous manner, the stop for the trigger can be formed by a rod whose ends are mounted in longitudinal slots in the trigger assembly housing in the direction of displacement, the rod extending at right angles to the direction of movement of the trigger and being coupled with an actuating member in the path of travel of the cocking mechanism. The actuating member can then simply be a lever mounted in the trigger assembly housing, with one arm extending into the path of travel of a component of the cocking mechanism, while the other arm has a cam which is in a contacting relationship with the rod.

As was already mentioned above, it is known practice with air guns to keep the trigger blocked until the cocking mechanism has almost returned to its position of rest and blocking of this type is also possible with the trigger mechanism according to the present invention. In a preferred embodiment of the present invention, it is the intermediate members themselves which cause the trigger mechanism to be blocked in a known manner and to remain blocked until just before the trigger is displaced. If the actuating member is a lever with a cam, of the type discussed above, this lever can have an arm which blocks the trigger, similar to that which is known from German Pat. No. 1,183,407.

The employment of the trigger mechanism according to the present invention does not depend upon the nature of the cocking mechanism, as every cocking mechanism must of necessity have a member which performs a reciprocating movement, which would be suitable for controlling the intermediate members. In the case of break-open weapons, for example, the movement of the cocking members deflected on the breaking section could be utilized. However it would, for example, also be possible to mount a rod in the shaft which can be displaced parallel to the barrel, with the rear end of the breaking section coming into a contacting relationship with the rod shortly before it is returned to its initial position. In the same manner, for example, in weapons having a laterally arranged cocking lever which can be pivoted by hand, it would be possible to arrange an intermediate member in the path of travel of this cocking lever. In all of these cocking mechanisms, the cocking mechanism generally first travels a certain amount of slack before it becomes effective. This slack, in particular, can be utilized for actuating the intermediate members, thereby reducing the overlap in the area of this slack, which is not of any significance whatsoever for the cocking sequence.

The above discussed and other objects, features and advantages of the present invention will become more apparent from the following description thereof, when taken in conjunction with the accompanying drawings of a practical example, in which FIG. 1 shows a partial top view and a partial section of those members of an air rifle required for understanding the invention, in the position which they assume at the beginning of a cocking sequence at the end of the play;

Figure 1:
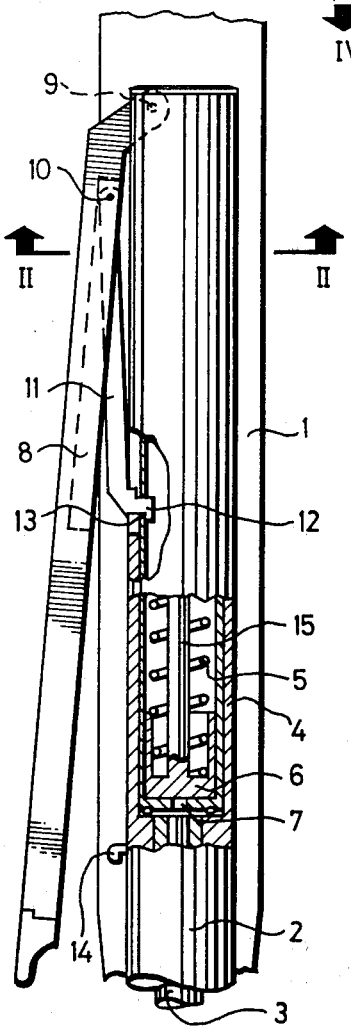
Figure 3:
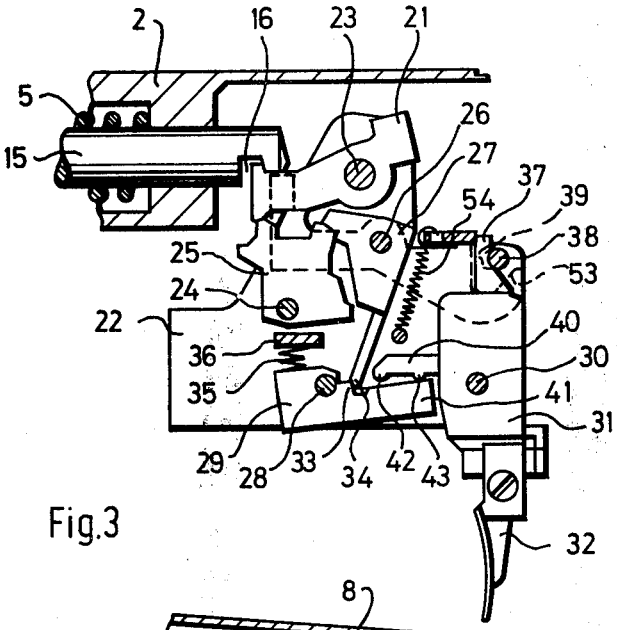
FIG. 3 shows a section taken along Line III—III through the arrangement according to FIG. 2.
Figure 6:
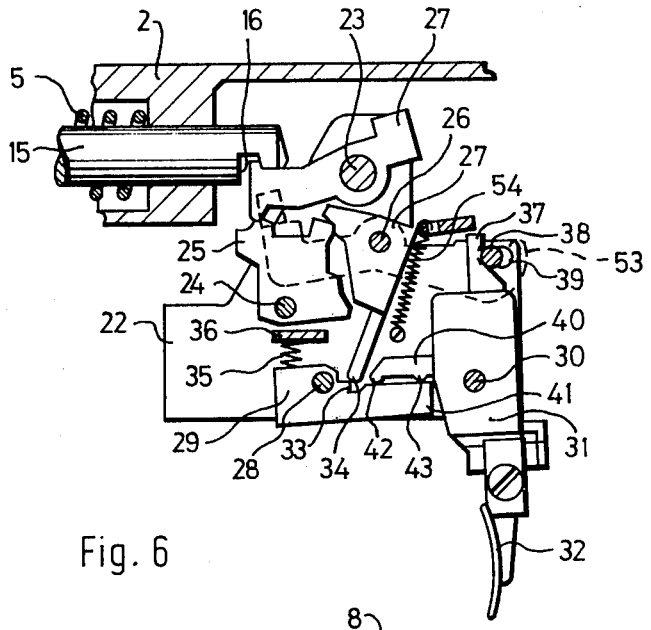

Referring now to the drawings, wherein like reference numerals designate like parts throughout the several views, the rifle illustrated in the drawing has a shaft 1 containing a receiver 2, whose front section contains a barrel 3, which is followed rearwardly by the mechanism serving to generate the compressed air. This mechanism includes a compression cylinder 4, slidably mounted in receiver 2, with a piston 6, loaded by a compression spring 5, being arranged in compression cylinder 4. The front end of compression cylinder 4 has a hole 7 which is in alignment with the bore of barrel 3. Compression spring 5 is tensioned by means of a cocking lever 8, whose rear end is mounted on a bolt 9 in receiver 2. A draw bar 11, whose nose 12 is engaged in a recess 13 in compression cylinder 4, is pivoted to the rear end of cocking lever 8 by means of a bolt 10. The length of recess 13 is greater than the width of nose 12, thereby permitting the nose to move longitudinally relative to compression cylinder 4 in the recess. In its position of rest, cocking lever 8 rests flatly against the outside of receiver 2, and is retained by means of a catch 14. Cocking lever 8 can be swivelled out of this position of rest into the attitude illustrated in FIG. 1 without initiating the cocking sequence. Only in the attitude of cocking lever 8 illustrated in FIG. 1 does nose 12 of draw bar 11 come into a contacting relationship at the rear edge of recess 13, whereupon it then drives compression cylinder 4, with piston 6, against the force of compression spring 5 when the cocking lever is moved further. Piston 6 has a rod 15, whose rear end has a notch 16, which is engaged by a sear 21 with the piston in the cocked position, as shown in FIGS. 3 and 6.

Sear 21 is a component of the rifle's trigger mechanism, whose members are arranged between the walls of a trigger assembly housing 22, located beneath the rear section of receiver 2 in shaft 1. In addition to sear 21, mounted on a bolt 23, the trigger mechanism also includes an intermediate link 25, mounted on a bolt 24, a catch lever 27, pivotally mounted on a bolt 26, a trigger lever 29, mounted on a bolt 28, and a trigger 31, mounted on a bolt 30, with a trigger blade 32 being attached to trigger 31.

Sear 21, intermediate link 25 and catch lever 27 form a lever linkage system for multiple reduction of the force exerted on the trigger mechanism by compression spring 5 via rod 15. The connection between notch 16 in rod 15 and sear 21, as well as the adjacent surfaces of sear 21, intermediate link 25 and catch lever 27 are not self locking. Rod 15, subjected to the force of compression spring 5, is first held by trigger lever 29, which has a nose 33 against which the end of arm 34 of catch lever 27 is in a contacting relationship. Trigger lever 29 is subjected to the force of a spring 35, which is in supporting relationship with a stud 36, arranged between the walls of trigger assembly housing 22, and which attempts to place trigger lever 29 in a position in which nose 33 greatly over-laps arms 34 of catch lever 27, as is illustrated in FIG. 3.

The position of trigger lever 29 is determined by trigger 31. In its position of rest, an arm 37 of trigger 31, arranged at the opposite end from the trigger blade 32, is in a contacting relationship with a rod 38, whose ends are mounted in longitudinal slots 39 in the walls of trigger assembly housing 22. Thus, rod 38 extends parallel to bolt 30, on which trigger 31 is mounted, and thus at right angles to the direction of travel of arm 37 of trigger 31. Longitudinal slots 39, on the other hand, extend generally parallel to the direction of travel of arm 37. Trigger 31 also has an arm 40, arranged at right angles to arm 37, with arm 40 extending generally parallel to an arm 41 of trigger lever 29 and overlapping this arm.

The bottom of arm 40 of trigger 31 has two projections 42 and 43, the first being arranged in the vicinity of the free end of arm 40, with the other arranged at a certain distance therefrom. As illustrated in FIG. 3, spring 55 normally presses arm 41 of trigger lever 29 against the bottom of arm 40 of trigger 31, thereby exerting a clockwise torque against trigger 31, which causes the other arm 37 of trigger 31 to be pressed against rod 38, which is located at the right, i.e. rear, end of longitudinal slots 39 in FIGS. 3 and 6. The arrangement is selected in such a manner that nose 33 on the trigger lever greatly overlaps the end of arm 34 on catch lever 27. Moreover, arm 41 of the trigger lever is in a contacting relationship with rear projection 43 on arm 40 of trigger 31.

The arrangement described above is a two-stage trigger, of the type available in commercial air rifles. When the trigger is pulled, i.e. when trigger blade 32 is moved to the right in FIG. 3, trigger 31 swivels clockwise, driving trigger lever 29 by means of projection 41. This reduces the overlap with arm 34 of catch lever 27. The force required herefor is determined generally by the strength of spring 35 and the leverage ratio resulting from the distance between projection 41 from bolt 30 for trigger 31 and bolt 28 for trigger lever 29. When projection 42 at the end of arm 40 of trigger 31 comes into a contacting relationship with the upper side of arm 41 of trigger lever 29, this leverage is altered, as the pivotal point is now determined by projection 42. The alternation of the leverage ratio increases the trigger pull, thereby producing a so-called letoff point. At the same time, the overlap of nose 33 over arm 34 of catch lever 27 is reduced so much that only a very short movement of trigger blade 32 is sufficient to bring nose 33 out of engagement with arm 34 after the letoff point has been reached, thereby releasing rod 15 with piston 6.

Figure 2:
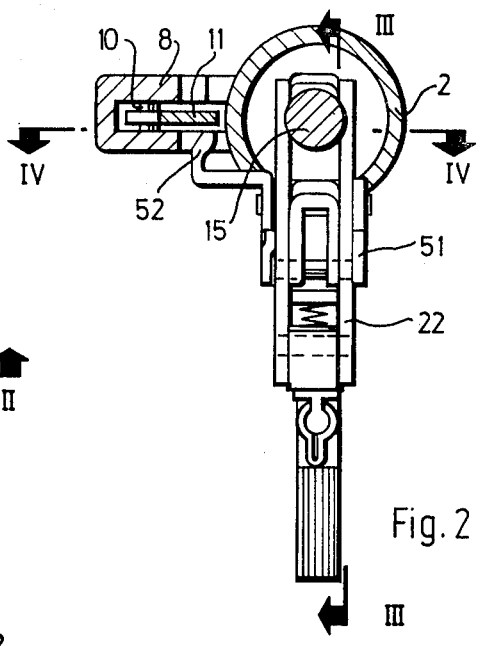
FIG. 2 shows a section taken along Line II—II through the arrangement according to FIG. 1, on a larger scale, with the shaft being left away.
Figure 5:
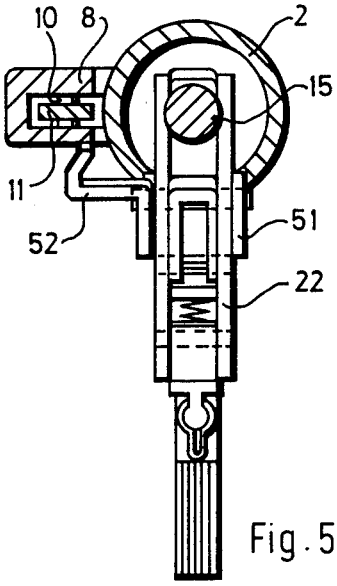
FIGS. 5 to 7 show sections corresponding to FIGS. 3 to 5, however with the members in the position they assume after the weapon has been fully cocked.
Figure 4:
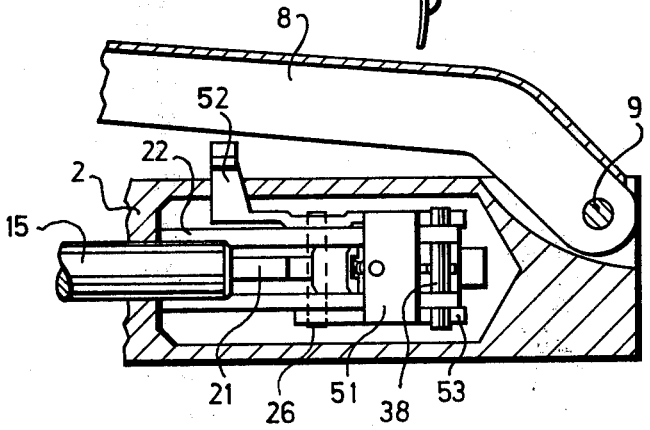
FIG. 4 shows a section taken along Line IV—IV through the arrangement according to FIG. 2.
Figure 7:
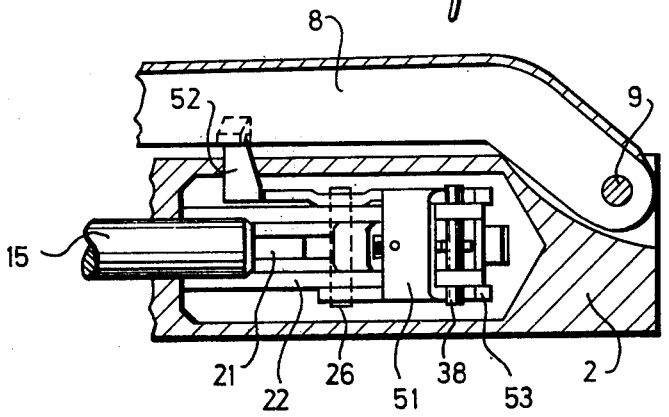

The illustrated trigger mechanism has an additional actuator in the form of a lever 51, which is of U configuration and which overlaps trigger assembly housing 22 from above. This lever 51 is pivotally mounted about the same bolt 26 as catch lever 27. On the side facing cocking lever 8, lever 51 has an arm 52, which extends into the path of travel of cocking lever 8 and which is in a contacting relationship with the bottom of cocking lever 8 when the cocking lever is in its position of rest, as shown in FIGS. 5 and 7, and which is released by cocking lever 8 before cocking lever 8 has completed its slack travel, i.e. before it has reached the attitude illustrated in FIG. 1, as shown in FIGS. 2 and 4. On the end of lever 51 facing away from arm 52, those members which are in a contacting relationship with the outside of trigger assembly housing 22 have fork-shaped sections with cam 53, which support the ends of rod 38 extending beyond the walls of the trigger assembly housing, with which trigger 31 is in a supporting relationship in its position of rest. Acting at the cross member of lever 51 is a helical tension spring 54, which attempts to bring the cross member into a contacting relationship with the top of trigger assembly housing 22. In this position, arm 52 of lever 51 extends into the path of travel of cocking lever 8. If cocking lever 8 is in its position of rest, it swivels lever 51, acting as an actuator, in a direction which causes its cross member to be lifted away from trigger assembly housing 22.

If cocking lever 8 is disengaged from its position of rest for cocking the weapon, it releases arm 52 of lever 51 before it has reached the end of its play. This permits the helical tension spring to bring lever 51 into its position of rest, in which its cross member is in a contacting relationship with the top of the trigger assembly housing. In this position, cams 53 on lever 51 are out of engagement with rod 38, permitting it to be in a contacting relationship at the rear end of longitudinal slots 39. Trigger 31 therefore assumes the position which can be seen in FIG. 3, in which trigger lever 29 is in a contacting relationship with rear projection 41, greatly overlapping arm 34 of catch lever 27 with its nose 33. At the same time, the cross member of lever 51 blocks upper arm 37 of trigger 31, thereby arresting the trigger in this position and preventing it from moving. The weapon is thus absolutely safe as long as cocking lever 8 is out of its position of rest.

If cocking lever 8 is returned to its position of rest after the cocking sequence is completed, it deflects lever 51, serving as an actuator, in the area of its play, causing the cross member of this lever to lift away from the top edge of trigger assembly housing 22, thereby moving it out of the path of travel of arm 37 of trigger 31. This eliminates the blocked condition of trigger 31 and releases the trigger for pulling. In addition, cams 53 at the ends of lever 51 come into engagement with the ends of rod 38, and push the rod forward in its longitudinal slots 39, theregy altering the position of rest of trigger 31. The cams are designed in such a manner that when lever 51 is swivelled, rod 38, which serves as a stop for trigger 31, is shifted enough so that trigger 31 is swivelled until front projection 42 of its arm 40 comes into a contacting relationship with the top of arm 41 of trigger lever 29. This means that the trigger is swivelled the entire path of the slack, until the letoff point. The condition at this point is illustrated in FIG. 6. As can be seen, this movement of the trigger reduces the overlap of nose 33 over arm 34 of catch lever 27 to a very small amount, so that all that is now required to fire a shot is a slight pressure against trigger blade 32. The trigger is therefore highly sensitive after completion of the loading sequence, while ensuring maximum safety during the cocking and loading sequence.

As can be seen from the above, the present invention can be realized with extremely simple means, i.e. by making a minor alternation to the lever employed as an actuator, which was required previously for blocking the trigger, and a minor alteration to the stop for the position of rest of the trigger. If a lever 51 is employed in which there is no rear section with cam 53, the above-described trigger can be employed as a normal two-stage trigger.

It can also be seen that the same effect can be achieved if the intermediate members actuated by the cocking mechanism do not act on the trigger, but on the trigger lever and there is a spring which keeps the trigger in a contacting relationship with the trigger lever at all times. Moreover, it can also be readily seen that it makes no difference which component of the cocking mechanism actuates the intermediate member which causes the overlap to be reduced, but that it must always be possible to derive a movement of this type from a movable member, thereby producing the required displacement. For this reason, the present invention is not limited to air guns having a lateral cocking lever, but can also be employed with air guns having cocking levers arranged in a different manner or also with break-open weapons. In principle, the displacement of the trigger set forth in the present invention is possible with all weapons in which there is a cocking or loading motion.

Obviously, many modifications and variations of the present invention are possible in the light of the above teachings. It should therefore be understood that within the scope of the appended claims, the invention may be practiced otherwise than as specifically described.

I claim:

1. In an air gun including a spring loaded piston, a trigger mechanism comprising:

cocking means movable between a rest position and a cocking position for cocking the piston;

trigger mechanism means for retaining and releasing the cocked piston, which trigger mechanism means includes a retaining member connected to said piston, a trigger lever engageable with said retaining member when said piston is cocked, said trigger lever having a portion overlapping said retaining member when in engagement therewith, and a trigger coupled to said trigger lever for moving said trigger lever out of engagement with said retaining member; and intermediate means including intermediate members operatively coupling said cocking means and said trigger lever for reducing the overlap of said trigger lever over said retaining member after cocking during the last part of travel of said cocking means back to said rest position.

2. The trigger mechanism according to claim 1, in which said intermediate members cause said trigger to be displaced in the direction of the triggering.

3. The trigger mechanism according to claim 2, said trigger mechanism means also including means for altering the leverage ratio between said trigger lever and said trigger and defining a letoff point in which said intermediate members cause said trigger to be displaced until said letoff point.

4. The trigger according to claim 2, in which, in its position of rest, said trigger is in a contacting relationship with a stop which can be shifted by means of said cocking mechanism.

5. The trigger mechanism according to claim 4, also comprising a trigger assembly housing in which said trigger mechanism is mounted, and in which said stop is formed by a rod whose ends are mounted in longitudinal slots in said trigger assembly housing in the direction of displacement of said rod, said trigger mechanism further including an actuating member movably mounted on said trigger assembly housing, said rod extending at right angles to the direction of movement of said trigger and being coupled with said actuating member arranged in the path of travel of said cocking mechanism.

6. The trigger mechanism according to claim 5, in which said actuating member is a lever mounted in the trigger assembly housing, with one arm of said lever extending into the path of travel of a member of said cocking mechanism, while the other arm of said lever has a cam which is in a contacting relationship with said rod.

7. The trigger mechanism according to claim 6, in which said lever has a section which blocks said trigger.

8. The trigger mechanism according to claim 1, in which said intermediate members cause the trigger mechanism to be blocked and to remain blocked until just before said trigger lever is displaced.

9. The trigger mechanism according to claim 1, in which when said cocking means is actuated between its position of rest and the beginning of the cocking sequence it has a path of play, with the overlap being reduced in the area of said path of play.

10. The trigger mechanism according to claim 1, in which said cocking mechanism comprises a cocking lever, and one of said intermediate members is arranged in the path of travel of said cocking lever.

* * * * *